US005523197A

United States Patent [19]

Heremans

[11] Patent Number: 5,523,197

[45] Date of Patent: Jun. 4, 1996

[54] MULTILAYER DIRECT-POSITIVE PHOTOGRAPHIC MATERIAL AND PROCESS FOR PREPARING THE SAME

[75] Inventor: Luc Heremans, Leuven, Belgium

[73] Assignee: Agfa-Gevaert, N.V., Mortsel, Belgium

[21] Appl. No.: 420,563

[22] Filed: Apr. 12, 1995

[30] Foreign Application Priority Data

May 6, 1994 [EP] European Pat. Off. ..... 94201277

[51] Int. Cl.[6] ..... G03C 1/035; G03C 1/485

[52] U.S. Cl. ..... 403/502; 430/503; 430/507; 430/508; 430/523; 430/589; 430/596; 430/598; 430/940

[58] Field of Search ..... 430/598, 502, 430/507, 523, 589, 966, 940, 935, 503, 596, 508

[56] References Cited

U.S. PATENT DOCUMENTS 3,615,573 10/1971 Smith, Jr. et al. .

3,647,463 3/1972 Taber et al. .

4,273,862 6/1981 Yoshida et al. ..... 430/589

4,311,787 1/1982 Lemahieu et al. .

5,043,259 8/1991 Arai ..... 430/596

*Primary Examiner*—Thorl Chea

*Attorney, Agent, or Firm*—Breiner & Breiner

[57] ABSTRACT

In order to provide a direct-positive material having low contrast and extended latitude that can be manufactured in a consistent and reproducable way a multilayer direct-positive photographic material is disclosed as well as the process to provide it, characterized by the steps of coating on one side of a support at least two layers of direct positive silver halide emulsions of the externally fogged type, at least one layer of which comprises a mixture of direct positive silver halide emulsions of the externally fogged type and at least one layer of which comprises one or more filter dyes; overcoating said emulsion layers with at least one protective layer; coating on the other side of the support at least one backing layer.

8 Claims, No Drawings

MULTILAYER DIRECT-POSITIVE PHOTOGRAPHIC MATERIAL AND PROCESS FOR PREPARING THE SAME

FIELD OF THE INVENTION

The present invention relates to a silver halide photographic material having a multilayer arrangement of light-sensitive silver halide emulsion layers comprising direct-positive emulsions.

BACKGROUND AND OBJECT OF THE INVENTION

In silver halide photography a photographic method, according to which a positive image is made without the use of a negative image or an intermediary process producing a negative image, is called a direct-positive method. A photographic light-sensitive material and a photographic emulsion for use according to such photographic method are called direct-positive material and direct-positive emulsion respectively.

A variety of direct-positive photographic methods are known. The most useful methods are the method, which comprises exposing prefogged silver halide grains to light in the presence of internal or external electron acceptors and developing them, and the method, which comprises subjecting a silver halide emulsion containing silver halide grains that have light-sensitive specks mainly inside the grains to an image-wise exposure and developing the exposed emulsion in the presence of a development nucleator.

With externally fogged direct-positive emulsions it is not easy to reach the high sensitivity level which can be obtained with internal latent image type direct-positive emulsions and which are developed by fogging development, e.g., by using hydrazines. This is probably due, at least partially, to the heterogeneous character of the external chemical fogging. However direct-positive emulsions show the advantage of not requiring a rather unecological processing as is the case when fogging developers are used. Especially in applications wherein copies are required from, e.g., radiological images of an X-ray diagnosis, the sensitivity of the externally fogged direct-positive emulsions used in such material is sufficient. Further an adequate and reproducible exposure latitude is required for a duplicating material. Because an accurate reproduction of an original image, without losses in image quality, neither in image density nor in image detail, is highly preferred, a direct-positive material with a low average contrast of about 1.0 is desired having a sensitometric curve showing an acceptable linearity without deviations or irregularities.

An improved layer arrangement in order to get a direct-positive element of extended latitude has been described in U.S. Pat. No. 3,647,463. However high amounts of silver coated in said layer arrangement cause a higher cost, a longer processing time, more silver recoverage and more environmental load.

Another attempt by making mixtures of at least 4 or 5 emulsions in one emulsion layer in order to controll the production is very disadvantageous with respect to the consistency in the manufacturing of direct-positive materials. Moreover an intensive controlling is required.

Therefor it is an object of the present invention to provide a direct-positive material having a low contrast and an extended latitude.

More specifically it is an object to provide a process for the reproducible and consistent manufacturing of such direct-positive material in order to make copies from radiological images.

Other objects will become apparent from the description hereinafter.

SUMMARY OF THE INVENTION

The objects of the present invention are attained by providing a multilayer direct-positive material obtained by the steps of coating on one side of a support at least two layers of direct positive silver halide emulsions of the externally fogged type, at least one layer of which comprises a mixture of direct positive silver halide emulsions of the externally fogged type and at least one layer of which comprises one or more filter dyes, overcoating said emulsion layers with at least one protective layer, coating on the other side of the support at least one backing layer.

DETAILED DESCRIPTION OF THE INVENTION

The direct-positive photographic emulsions used according to this invention can be prepared from direct-positive silver halide crystals precipitated in the presence of a protective colloid. Soluble silver salts and soluble halides can be mixed therefor according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion". The Focal Press, London (1966). As a protective colloid gelatin is the most preferred one. However, it can be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates. A very suitable substitute for gelatin is colloidal silica as has been shown in EP-A 528 476 in order to reduce the pressure sensitivity of the silver halide crystals.

Preferably the pAg range for the precipitation of the silver halide crystals for use in the multilayer material according to this invention is chosen such that an essentially cubic emulsion grain is obtained. By essentially cubic is meant a grain which either is (a) perfectly cubic, or (b) cubic with rounded corners, or (c) cubic with small (111) faces on the corners so that in fact a tetradecahedrical emulsion is obtained, the total area of these (111) faces however being small compared to the total area of the (100) faces. Moreover a cubo-octahedral shape is not excluded and depends on the effective pAg values applied during the precipitation of the silver halide crystals.

The precipitation can be principally performed by one double jet step; alternatively it can consist of a sequence of a nucleation step and at least one growth step. In the latter case, of the total silver precipitated preferably 0.5% to 5.0% is added during said nucleation step which consists preferably of an approximately equimolecular addition of silver and halide salts. The rest of the silver and halide salts is then added during one or more consecutive double jet growth steps. The different steps of the precipitation can be alternated by physical ripening steps. During the growth step(s) the flow rate of the silver salt and halide solutions can be kept constant; alternatively an increasing flow rate of silver salt and halide ion solutions can be established, e.g. a linearly increasing flow rate. Typically the flow rate at the end is about 3 to 5 times greater then at the start of the growth step. These flow rates can be monitored by e.g. magnetic valves.

In a preferred embodiment of the present invention the essentially cubic host emulsion is formed simply by one double jet step at a pAg maintained at a constant value between 7 and 10, and more preferably between 7 and 9, without separate nucleation step and at a constant flow rate. The constant pAg is realized by the use of a so-called "bypass solution" the addition of which is alternatingly switched on and off. The concentrations of the main silver salt and halide solutions typically range between 0.5 and 3 molar, and most preferably between 1 and 2 molar.

Silver halide crystals used in the light-sensitive layers of the multilayer direct-positive materials, prepared according to this invention can have any halide composition, a silver bromoiodide composition having an iodide content from 0 up to 5 mole % being preferred and an iodide content from 0 to 2 mole % being still more preferred. Iodide ions can be distributed over the volume of the whole crystal lattice in a homogenous or heterogenous manner. When phases differing in silver bromoiodide composition are present over the crystal volume said crystal has a core shell structure. More than one shell can be present and between different phases it can be recommended to have an enriched silver iodide phase by applying the so-called conversion technique. Iodide ions can be provided by using aqueous solutions of inorganic salts thereof as, e.g., potassium iodide, sodium iodide or ammonium iodide. Iodide ions can also be provided by organic compounds releasing iodide ions as has e.g. been described in EP-A 561 415, 563 701, 563 708, in 93202899.6, filed Oct. 15, 1993 and in 93203040.6, filed Oct. 29, 1993.

The crystals may further be doped with whatever a dope, as e.g. with $Rh^{3+}$, $Ir^{4+}$, $Cd^{2+}$, $Zn^{2+}$, $Pb^{2+}$.

The crystal size obtained at the end of the precipitation depends on many factors as there are the amount of silver precipitated during the nucleation step, the initial concentration of reagents present in the reaction vessel, the flow rate of silver salt and halide salt solutions, the temperature, pAg, the presence of growth accelerators, etc. According to this invention crystals having an average diameter from 0.2 to 2 μm can be prepared, an average diameter from 0.2 to 0.5 μm being more preferred and from 0.3 to 0.5 μm even more preferred in view of obtaining a better (more bluish, cold) image tone.

In one embodiment of the present invention the emulsion is made free from excess of soluble inorganic salts by a conventional wash technique, e.g. flocculation by ammonium sulphate or polystyrene sulphonate, followed by several washing steps and redispersion. Another well-known wash technique is ultrafiltration. Finally extra gelatin can be added to the emulsion in order to obtain the desired gelatin to silver ratio.

In accordance with the present invention mixtures of emulsions comprising fogged silver halide crystals are used. Emulsions differing from one another in average crystal size and in morphology can be made, and eventually said emulsions differing from each other can be obtained from the same fine silver halide "mother" emulsion nuclei, the mixture then being fogged. According to this invention it is however preferred that said mixture consists of direct—positive silver halide emulsions composed of samples of the same emulsion, but each sample being externally fogged to a differrent degree.

Surface fogging process that passes at silver halide surface of the crystals can be effected by chemically sensitising to fog with sensitizing agents well-known in the art. Fogging can proceed by means of a reduction sensitiser, a noble metal salt such as a gold salt together with a reduction sensitiser, a sulphur sensitiser, a high pH-value and a low pAg-value. Reduction sensitisation causing fog can, e.g., be attained by reduction with a strong reducing agent which introduces small specks of metallic silver onto the silver halide crystals, preferably having a cubic habit. Examples of especially useful compounds having reducing properties are, e.g., thioureumdioxide, tin compounds as described in GB-A 789,823, amines, hydrazine derivatives, formamidine-sulphinic acids, silane compounds and the like.

According to this invention differences in external fogging degree are attained by using different amounts of reducing agent(s), but it is also possible to prepare emulsion crystals reduction sensitised to a different extent by variations of pH, pAg, temperature and reduction sensitisation time.

As the emulsions made ready for coating according to this invention are comprising fogged grains, it is necessary to add electron acceptors to the emulsion, as e.g. pinakryptol yellow etc. described in U.S. Pat. No. 3,963,494 and DE-PS 1 547 643 or electron acceptors providing spectral sensitisation, like e.g. imidazo[4,5-b]quinoxaline dyes, described in BE-Patents 660 253 and 695 364, in U.S. Pat. No. 3,431,111 and in RD 83006, March 1971.

The silver halide emulsions can further be spectrally sensitised with methine dyes such as those described by F. M. Hamer in "The Cyanine Dyes and Related Compounds", 1964, John Wiley & Sons. Dyes that can be used for the purpose of spectral sensitisation include cyanine dyes, merocyanine dyes, complex cyanine dyes, complex merocyanine dyes, hemicyanine dyes, styryl dyes and hemioxonol dyes. Particularly valuable dyes are cyanine dyes, merocyanine dyes and complex merocyanine dyes. Said dyes are broadening the spectral region to which the light-sensitive silver halide crystals are sensitive in order to capture the light emitted from the light source, as non-spectrally sensitised silver halide crystals used in the process for preparing a multilayer material according to this invention are only sensitive in the ultraviolet and blue region of the spectrum. Preferably the spectrum is of the spectrally sensitised silver halide crystals is comprised between 350 and 500 nm.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3.457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products as described e.g. in U.S. Pat. No. 3,743,510, cadmium salts, and azaindene compounds.

Depending on the application the direct-positive emulsions comprising silver halide crystals are spectrally sensitised in order to be sensitive to the light sources used, whether or not emitting visible radiation.

According to this invention at least one non-spectrally sensitising dye is added to at least one of the emulsion layers comprising a mixture of direct-positive silver halide emulsions as a filter dye. The presence of said dye(s) is not only recommended to adjust the sensitivity of the different emulsion layers and the required low contrast approximating a value of 1.0, but also in order to reduce scattering of exposure radiation and thus to enhance sharpness. Preferred dyes are those that can be removed relatively easily in aqueous alkaline processing liquids and that can diffuse sufficiently fast throughout hydrophilic colloid layers in said processing. During coating of the hydrophilic layers comprising said dye(s), it is clear that said dye(s) should be non-diffusable.

Examples of said dyes, without being limited thereto, are the dyes that have been described in, e.g., U.S. Pat. Nos. 3,560,214, 3,647,460, 4,288,534, 4,311,787, 4,857,446 etc.. Monomethine dyes have an absorption spectrum of which the maximum is in the shorter wavelength range of the visible spectrum so that normally a second filter dye is needed to block or absorb green light and even a third one to absorb radiations of longer wavelengths, e.g. radiations in the red or even in the infrared region.

Once a filter dye has been selected, the problem is how to get the filter dye in a coated layer so that all the requirements mentioned previously are met. One of the preferred possibilities is to make use of solid particle dispersions of water insoluble dyes as has been described in EP 0,384,633 A2; EP 0,323,729 A2; EP 0,274,723 B1, EP 0,276,566 B1, EP 0,351,593 A2, EP-A's Nos 92202765, 92202767, 92202768 and U.S. Pat. Nos. 4,900,653; 4,904,565; 4,949,654; 4,940,654; 4,948,717; 4,988,611 and 4,803,150.

Another possibility is to prepare said dyes in the form of a solid silica particle dispersion as disclosed in EP-A 569 074.

Still another possibility to obtain ultra fine dye dispersions consists in acidifying a slightly alkaline coating composition "in situ" just before coating it onto the supporting layer. It has been found that the application of this dosage technique allows us to obtain the dyes in a very fine solid particle form, homogeneously divided into the coated layer so that solid particles can hardly be observed even by means of microscopic techniques.

The non-diffusing dyes added to a hydrophilic layer of a photographic element as a solid particle has a mean diameter of less than 10 μm, more preferably less than 1 μm and still more preferably less than 0.1 μm.

At a pH of at least 10 the dispersed filter dyes are easily solubilized so they are removed almost completely from a hydrophilic waterpermeable colloid layer of a photographic silver halide emulsion material by its common alkaline aqueous liquid processing and leave almost no residual stain. The presence of sulfite in the processing solution contributes to a more rapid discoloration of the filter dyes.

The dye(s) incorporated in the emulsion layer(s) of the multilayer direct-positive material prepared in accordance with the present invention preferably have the general structure (I)

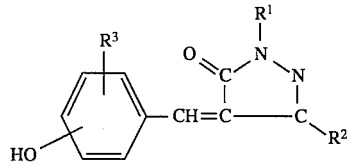

(I)

in which $R^1$ is hydrogen, alkyl, substituted alkyl, aryl, substituted aryl, aralkyl or substituted aralkyl, $R^2$ is carboxy, alkoxycarbonyl, aryloxycarbonyl, carbamoyl, ureido, sulphamoyl or one of the groups represented by $R^1$;

at least one of $R^1$ and $R^2$ being or containing carboxy or carbamoyl, $R^3$ is hydrogen, $C_1$–$C_4$ alkyl or $C_1$–$C_4$ alkoxy, and when $R^3$ is alkyl or alkoxy it stands in ortho or para in respect of the hydroxy group, which itself is in ortho or para in respect of the methine group; said merostyryl dye containing further no group that renders the dye soluble in the hydrophilic colloid layer.

Although present in at least one emulsion layer according the preparation method of this invention, the same or other dye(s) can be present in a backing layer, an antihalation undercoating layer, an intermediate layer and/or a protective outermost layer, depending on the requirements. Further non-spectrally sensitised dyes that may be present in the emulsion layer(s) are those influencing image tone because for the developed silver a pure black image tone is highly preferred. Chemical agents in the material or in the processing liquids that cause colour stain or silver filaments from developed crystals having a small average diameter may cause a slightly coloured image after processing, differing from the normally expected black silver image. Examples of suitable non-spectrally sensitised dyes are those disclosed in FR 1 179 126.

The silver halide emulsion for use in accordance with the present invention may comprise compounds preventing the formation of a high minimum density or stabilizing the photographic characteristics during the production or storage of photographic elements or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75-39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide. Other compounds that can be used as fog-inhibiting compounds are those described in Research Disclosure No. 17643 (1978), Chapter VI.

The fog-inhibiting agents or stabilizers can be added to the silver halide emulsion prior to, during, or after the ripening thereof and mixtures of two or more of these compounds can be used.

The photographic element of the present invention may comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g. higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805, 4,038,075, 4,292,400.

The photographic element of the present invention may further comprise various other additives such as e.g. compounds improving the dimensional stability of the photographic element, UV-absorbers, spacing agents, hardeners, and plasticizers as described below.

The layers of the photographic element, especially when the binder therein used is gelatin, can be hardened with appropriate hardening agents such as those of the epoxide type, those of the ethylenimine type, those of the vinylsulfone type e.g. 1,3-vinyl-sulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts.

The emulsion may be coated on any suitable substrate such as, preferably, a thermoplastic resin e.g. polyethyelenterephtalate or a polyethylene coated paper support.

Suitable additives for improving the dimensional stability of the photographic element may be added, i.a. dispersions of a watersoluble or hardly soluble synthetic polymer e.g. polymers of alkyl(meth)acrylates, alkoxy(meth)acrylates, glycidyl(meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulphoalkyl(meth)acrylates, and styrene sulphonic acids.

Plasticizers suitable for incorporation in the emulsions according to the present invention are e.g. glycol, glycerine, or the latexes of neutral film forming polymers including polyvinylacetate, acrylates and methacrylates of lower alkanols, e.g. polyethylacrylate and polybutylmethacrylate.

Suitable UV-absorbers are i.a. aryl-substituted benzotriazole compounds as described in U.S. Pat. No. 3,533,794, 4-thiazolidone compounds as described in U.S. Pat. No. 3,314,794 and 3,352,681, benzophenone compounds as described in JP-A 2784/71, cinnamic ester compounds as described in U.S. Pat. No. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 μm and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The emulsion layers of the photographic element according to the present invention are forming a multilayer package. At least two emulsion layers coated adjacent to each other are present.

According to this invention at least one of said emulsion layers comprises a mixture of light-sensitive emulsions comprising prefogged silver halide crystals. Preferably said emulsions are only differing in that the degree of fogging is different as set forth above. In a preferred embodiment the number of prefogged emulsions used in each emulsion layer is kept to a minimum in order to make the manufacturing thereof simple and reproducible. In praxis the number of prefogged direct-positive emulsions used in each emulsion layer is related with the object of the invention to provide a low contrast material (preferably with a value of about 1.0) with an extended latitude and an undisturbed, straight sensitometric curve. Differences in average grain size and halide composition of the crystals mixed in one layer or in adjacent layers may be present but for reasons of reproducibility and consistency during manufacturing it is preferred to prepare only one emulsion, to divide said emulsion in different parts, to apply a different fogging to each part en to mix them together in such a way as to reach the objects of this invention as mentioned hereinbefore.

Beside the light-sensitive emulsion layers the photographic material according to this invention contains several non-light-sensitive layers. Adjacent to the emulsion layer situated farthest from the support a protective topcoat layer is present. Said topcoat layer may comprise various additives like surfactants, matting agents, lubricants, thickening agents, bactericides, antistatic agents etc. and may even be split up into two different layers. To the protective topcoat layer(s) one or more hardening agents may be added, preferably just before coating said layer(s). The same hardeners can be used as summarised hereinbefore. Further one or more non-spectrally sensitising dyes can be added, preferably during coating, in order to controll the sensitivity of the coated material.

One or more backing layers may be present in order to prevent curling of the direct-positive material according to this invention. Therefor the amount of gelatin coated is optimised.

Advantages offered by the method to prepare a multilayer direct-positive material according to this invention are related to the coated amount of silver, expressed as the equivalent amount of silver nitrate. A remarkable reduction from ca. 5 to 6 grams to amounts from 3 to 4 grams per square meter results from the multilayer construction as has been presented herein. Moreover from an ecological point of view said construction according to this invention offers the advantage of consuming less chemicals in the processing and during replenishment.

The processing of the photographic elements according to this invention is characterised by the steps of developing, fixing, rinsing and drying and proceeds within a total processing time of 38 to 210 s and more preferably from 45 to 90 s, depending on the type of material and the amount of silver coated therein.

Any chemicals known in the art can be used depending on their composition and particular application. For producing a black-and-white image they are preferably processed in a conventional phenidone/hydroquinone or substituted phenidone/hydroquinone developing solution and a conventional sodium and/or ammonium thiosulphate containing fixing solution.

The photographic silver halide materials prepared according to this invention can be used in various types of black-and-white photographic elements, especially in low-speed photographic elements such as materials used for graphic applications, for medical X-ray diagnosis and for micrographic applications as duplicating materials to provide copies from original images, etc.

The following examples illustrate the present invention without however limiting it thereto.

EXAMPLES

Example 1

1. Preparation of the emulsions

The following solutions were prepared:

a dispersion medium (C) in a reaction vessel containing 1500 ml of demineralised water, 50 g of inert gelatin and 15 g of methionine;

2000 ml of a 1.47 molar silver nitrate solution (A);

2165 ml of a solution 1.3 molar in potassium bromide and 0.0135 molar in potassium iodide (B1);

216,5 ml of the same latter solution (B2; "bypass" solution).

Solutions (A) and (B1) were added during 31 minutes at 57° C. in a balanced double jet to the reaction vessel containing dispersion medium (C) in such a way that, by means of interrupted addition of bypass solution (B2), the silver potential, measured by a silver electrode versus a saturated calomel electrode (S.C.E.), was maintained at a constant value of +20 mV, corresponding to a pAg of 8.3. The precipitated emulsion was physically ripened at 57° C. during 23 minutes. Then the pH was adjusted to 3.5 with sulphuric acid and the emulsion was flocculated by the addition of sufficient low-molecular weight polystyrene sulphonate solution. The flocculated emulsion was washed thoroughly for several times with water. Finally the emulsion was redispersed and gelatin and water were added to obtain a final emulsion of about 3.2 kg, having a gelatin/silver ratio (gesi), the latter expressed as silver nitrate, of 0.6, and an average grain size of 0.24 μm. The crystal morphology was essentially cubic as confirmed by electron microscopy.

The emulsion described above was divided into five portions, and each part was externally fogged at 52° C., pH 7.5 and different pAg values using a 0.05% thioureadioxide solution (fogging solution A) and a 0.06% gold(III) trichloride solution (fogging solution B) in amounts given in table 1. The fogging was terminated by cooling when an optimal maximum density-sensitivity relationship was reached. This resulted in emulsions Nos. 1-2-3-4-5.

TABLE 1

| Em. No. | ml sol. A/ mole Ag | ml sol. B/ mole Ag | pAg | pH | T |
|---|---|---|---|---|---|
| Em. 1 | 0.34 | 3.4 | 7.7 | 7.5 | 52 |
| Em. 2 | 0.76 | 3.4 | 7.7 | 7.5 | 52 |
| Em. 3 | 1.36 | 3.4 | 7.7 | 7.5 | 52 |
| Em. 4 | 4.08 | 3.4 | 7.7 | 7.5 | 52 |
| Em. 5 | 4.08 | 3.4 | 7.05 | 7.5 | 52 |

2. Preparation of a light-sensitive material

Emulsion coating solution(s) and a surface protective layer coating solution were applied onto a blue colored transparent polyester support, coated in advance on the side opposite to the emulsion layer with a back layer covered with a back surface protective layer.

A single layer was coated or a plurality of layers was coated, with a total silver coverage of 3.5 g/m$^2$, expressed as the equivalent amount of $AgNO_3$. When two emulsion layers were coated, the silver coverage in the upper layer is 2.45 g/m$^2$ and in the lower layer 1.05 g/m$^2$.

The different coating solutions were prepared each containing at Least one of the fogged emulsions Nos. 1 to 5 and 283 mg/mole Ag of an electron-accepting spectral dye, corresponding to following formula EA-1:

EA-1

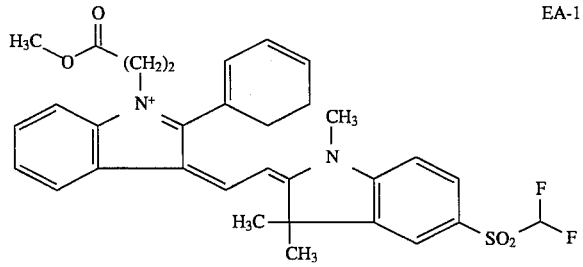

Further to the coating solution(s) were added suitable amounts of the stabilizer 5-nitrobenzimidazol and various coating aid solutions.

To at least one emulsion layer a filter dye was added, corresponding to following formula FD-1, in an amount shown in Table II.

FD-1

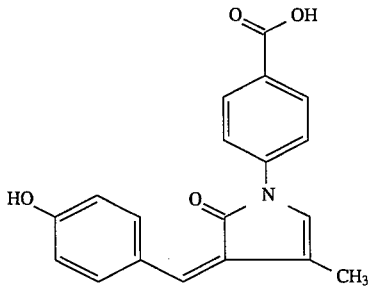

The samples were exposed in a Curix Printer, Trademarked name from Agfa-Gevaert, with 3 tubular lamps Sylvania type BLB FT 15 Watt-220 Volt, using a "0.20 Carbon Black" stepwedge.

The samples were developed in 23 seconds at 33° C. in a Curix 402 processor. Trademarked name from Agfa-Gevaert, in a developer having the following composition:

| | |
|---|---|
| hydroquinone | 30 g |
| 1-phenyl-pyrazolidine-3-one | 1.5 g |
| acetic acid 99% | 9.5 ml |

-continued

| | |
|---|---|
| potassiumsulphite | 63.7 g |
| potassiumchloride | 0.8 g |
| EDTA-2Na | 2.1 g |
| potassium carbonate | 32 g |
| potassiummetabisulfite | 9 g |
| potassiumhydroxide | 14 g |
| diethyleneglycol | 25 ml |
| 6-methylbenztriazol | 0.09 g |
| glutardialdehyd 50% | 9.5 ml |
| 5-nitroindazole | 0.25 g |
| demineralized water to make 1 l. | |

They were fixed in a conventional fixer, rinsed with water and dried.

3. Sensitometry

The speed is the point where a local gradation of 0.5 is reached and is expressed as relative log E value. A lower value means a higher speed. DMIN is the density at this point. The average gradation is the gradient of a line drawn by connecting the point at wich 0.25 is added at DMIN to the point at wich 1.75 is added at DMIN.

The sensitometric curve has to show an acceptable linearity without deviations or irregularities. The linearity is measured by a linear regression method, resulting in a Δ value. The results for this Δ value are classified according to the following five degrees:

A very good

B good

C acceptable

D nearly acceptable

E unacceptable

The results are summarised in Table 2.

TABLE 2

| Sample | Em in UL* | Em in LL** | FD-1 in UL g/mol Ag | FD-1 in LL g/mol Ag | Speed | Gradation | Δ | |
|---|---|---|---|---|---|---|---|---|
| 1*** | 1 43%<br>2 14%<br>3 13%<br>5 30% | — | — | — | 370 | 1.07 | E | comp. |
| 2 | 1 61%<br>2 21%<br>3 18% | 3 | — | — | 310 | 125 | E | comp. |
| 3 | 1 61%<br>2 21%<br>3 18% | 2 | — | — | 276 | 163 | D | comp. |
| 4 | 1 61%<br>2 21%<br>3 18% | 2 | 13.6 | — | 334 | 124 | B | inv. |
| 5 | 1 61%<br>2 21%<br>3 18% | 2 | — | 5.8 | 285 | 163 | B | inv. |
| 6 | 1 61%<br>2 21%<br>3 18% | 2 | 13.6 | 5.8 | 344 | 113 | B | inv. |
| 7 | 1 61%<br>2 21%<br>3 18% | 2 | 20.4 | 8.5 | 378 | 105 | B | inv. |
| 8 | 1 61%<br>2 21%<br>3 18% | 2 75%<br>1 25% | 17 | 6.8 | 359 | 97 | A | inv. |

*upper layer
**lower layer
***one emulsion layer

It can be concluded from the results summarised in Table 2 that Samples 4,5,6,7,8 have a very good linearity. In particular samples 7,8 show excellent characteristics for a duplicating material.

Example 2

The same emulsions and preparations of the light sensitive materials were used as in Example 1. In Example 2 another exposure is used: Delcopex Printer, Trademarked name from Agfa-Gevaert, with tubular lamps Philips type 03–20 Watt–220 Volt, and a maximum emission at 420 nm. The results are summarised in Table 3.

TABLE 3

| Sample | Em in UL* | Em in LL** | FD-1 in UL g/mol Ag | FD-1 in LL g/mol Ag | Speed | Gradation | Δ | |
|---|---|---|---|---|---|---|---|---|
| 1*** | 1 49%<br>2 17%<br>3 14%<br>4 10%<br>5 10% | — | — | — | 338 | 1.20 | E | comp. |
| 2 | 1 61%<br>2 21%<br>3 18% | 2 | 20.4 | 8.5 | 283 | 2.24 | C | inv. |
| 3 | 1 61%<br>2 21%<br>3 18% | 2 | 34 | 13.6 | 311 | 193 | B | inv. |
| 4 | 1 61%<br>2 21%<br>3 18% | 2 50%<br>3 50% | 34 | 13.6 | 330 | 126 | A | inv. |

It can be found from the results summarised in Table 3 that Samples 2,3,4 have a very good linearity. In particular Sample 4 shows excellent characteristics for a duplicating material.

I claim:

1. Method of preparing a multilayer direct-positive photographic material by the steps of coating on one side of a support at least two layers of externally fogged direct positive silver halide emulsions, at least one layer of which comprises a mixture of externally fogged direct positive silver halide emulsions said mixture comprising the same silver halide crystals, externally fogged to a degree differing from each other, and wherein each emulsion layer comprises the same filter dye or dyes, overcoating said emulsion layers with at least one protective layer, coating on the other side of the support at least one backing layer.

2. Method according to claim 1, wherein said filter dye or dyes are present in dispersed form.

3. Method according to claim 1, wherein said filter dye or dyes are present in solid particle dispersed form.

4. Method according to claim 1, wherein said filter dye or dyes belong to the class of merostyryl filter dyes, represented by the general formula (I),

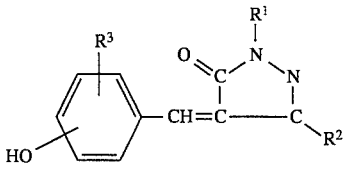

(I)

in which $R^1$ is hydrogen, alkyl, substituted alkyl, aryl, substituted aryl, aralkyl or substituted aralkyl, $R^2$ is carboxy, alkoxycarbonyl, aryloxycarbonyl, carbamoyl, ureido, sulphamoyl or one of the groups represented by $R^1$; at least one of $R^1$ and $R^2$ being or containing carboxy or carbamoyl, $R^3$ is hydrogen, $C_1$–$C_4$ alkyl or $C_1$–$C_4$ alkoxy, and when $R^3$ is alkyl or alkoxy it stands in ortho or para in respect of the hydroxy group, which itself is in ortho or para in respect of the methine group; said merostyryl dye containing further no group that renders the dye soluble in the hydrophilic colloid layer.

5. Method according to claim 4, wherein the differences in external fogging degree have been attained by application of different amounts of reducing agent(s).

6. Method according to claim 1, wherein said emulsions essentially comprise cubic grains consisting of silver bromide or silver iodobromide, having an iodide content from 0 to 5 mole %.

7. Multilayer direct-positive photographic material prepared according to the method of claim 1.

8. Multilayer direct-positive photographic material according to claim 7 wherein said material is a duplicating material.

* * * * *